US008371765B2

(12) United States Patent
Zabeo

(10) Patent No.: US 8,371,765 B2
(45) Date of Patent: Feb. 12, 2013

(54) APPARATUS FOR THE DEEP CLEANING OF SURFACES

(76) Inventor: Paolo Zabeo, Marghera (IT)

( * ) Notice: Subject to any disclaimer, the term of this patent is extended or adjusted under 35 U.S.C. 154(b) by 1190 days.

(21) Appl. No.: 12/281,771

(22) PCT Filed: Mar. 6, 2007

(86) PCT No.: PCT/IB2007/000519

§ 371 (c)(1),
(2), (4) Date: Sep. 5, 2008

(87) PCT Pub. No.: WO2007/102067

PCT Pub. Date: Sep. 13, 2007

(65) Prior Publication Data

US 2009/0061750 A1 Mar. 5, 2009

(30) Foreign Application Priority Data

Mar. 7, 2006 (IT) ..... PD2006A0076

(51) Int. Cl.
*A46B 11/00* (2006.01)

(52) U.S. Cl. ..... 401/44; 401/35

(58) Field of Classification Search ..... 401/44, 401/35, 34, 26, 25, 17, 16
See application file for complete search history.

(56) References Cited

U.S. PATENT DOCUMENTS

| | | | | |
|---|---|---|---|---|
| 5,169,251 | A | 12/1992 | Davis | |
| 6,588,961 | B2 * | 7/2003 | Lafosse-Marin et al. | 401/134 |
| 7,584,519 | B2 * | 9/2009 | Ouellette et al. | 15/227 |
| 7,604,623 | B2 * | 10/2009 | Brunner et al. | 604/385.101 |

* cited by examiner

*Primary Examiner* — Huyen Le
(74) *Attorney, Agent, or Firm* — Themis Law

(57) ABSTRACT

An apparatus is disclosed for the deep cleaning of surfaces, which comprises a support for at least two reservoirs arranged side-by-side and provided with deformable walls having uniformly perforated faces essentially facing the direction of the surface to be cleaned. At least one reservoir can contain a granular material for cleaning the surface and at least one reservoir can contain a fluid substance for the flowing of the granular material onto the surface. By means of the pressure exerted by a user on a support of the reservoirs in the direction of the surface to be cleaned, the granular material and the fluid substance flow from the corresponding reservoirs and are mixed together on the surface to be cleaned. A tangential movement of the reservoirs onto the surface conveys a compound of granular material and fluid substance onto the surface with a cleaning effect.

18 Claims, 3 Drawing Sheets

APPARATUS FOR THE DEEP CLEANING OF SURFACES

FIELD OF THE INVENTION

The present invention relates to an apparatus for the deep cleaning of surfaces.

BACKGROUND OF THE INVENTION

In order to restore surfaces damaged by dirt, oxides (such as rust), caking of various types, etc., to the original state, abrasive products are used such as sandpapers or abrasive disks, which eliminate the outermost layer of the surface to be regenerated, evening it out.

Such abrasive products are moved tangentially on the surface to be regenerated and the movement may be either manual (a simple manual movement of the sandpaper) or automated (such as in the case of disc or plate polishing machines).

Such polishing system may be essentially used on all surfaces but presents the problem of being particularly invasive with respect to the surfaces, because, as mentioned, the surface layers on which it acts are entirely removed. This may be a problem in all those applications, in which the cleaning of the surface must only concern portions of surfaces, for example in the case of the elimination of rust from metallic surfaces such as car bodies, ship hulls, etc. or in the case of deep cleaning of wall surfaces from dirt caked by time and by weather elements. In this case, the use of polishing machines is not recommended because it tends to remove the layers of paint, plaster and all the important external parts of the surfaces to be cleaned, which are instead not desired to be eliminated.

In all cases when operating on surfaces of these types, alternative dedicated cleaning techniques must be used, such as abrasive pastes on metal surfaces which do not damage the existing paints, or particular solvents for the deep surface cleaning of walls, etc.

The use of dedicated products implies various disadvantages, for example high cost (also considering the use on large surfaces, which commonly occurs) and the problems deriving from possible toxicity and environmental pollution. It is the main task of the present invention to provide an apparatus for the deep cleaning of surfaces, which solves the highlighted problems of the known art.

SUMMARY OF THE INVENTION

It is an important object of the present invention is to provide an apparatus for the deep cleaning of surfaces, which allows either avoiding or limiting the removal of the original surface layer of the surface intended to be cleaned in depth.

A further important object of the present invention is to provide an apparatus for the deep cleaning of surfaces, which is not polluting.

Another object of the present invention is to provide an apparatus for the deep cleaning of surfaces, which is easy to use.

These and other objects, which will be more apparent below, are achieved by an apparatus for the deep cleaning of surfaces that includes a support for at least two reservoirs disposed side-by-side, provided with deformable walls, which present corresponding uniformly and thoroughly perforated faces essentially facing the direction of the surface to be cleaned. At least one first reservoir is adapted to contain a surface cleaning granular material such as sand, and at least one second reservoir is adapted to contain a non-solid, fluid substance for facilitating the flowing of the sand on the surface, by means of the pressure exerted by a user on said support in the direction of the surface to be cleaned Said sand and said substance are issued from corresponding reservoirs and are mixed together on said surface to be cleaned, the tangential movement on the surface to be cleaned of said faces of said reservoirs conveying onto the surface the compound of the granular material with the fluid material, thereby providing an asperity and surface concavity cleaning effect.

BRIEF DESCRIPTION OF THE FIGURES

Further features and advantages of the invention will be more apparent from the description of two preferred but not exclusive embodiments, shown by way of indicative and non-limitative example in the accompanying drawings, in which.

DESCRIPTION OF THE PREFERRED EMBODIMENTS

Figure 1:
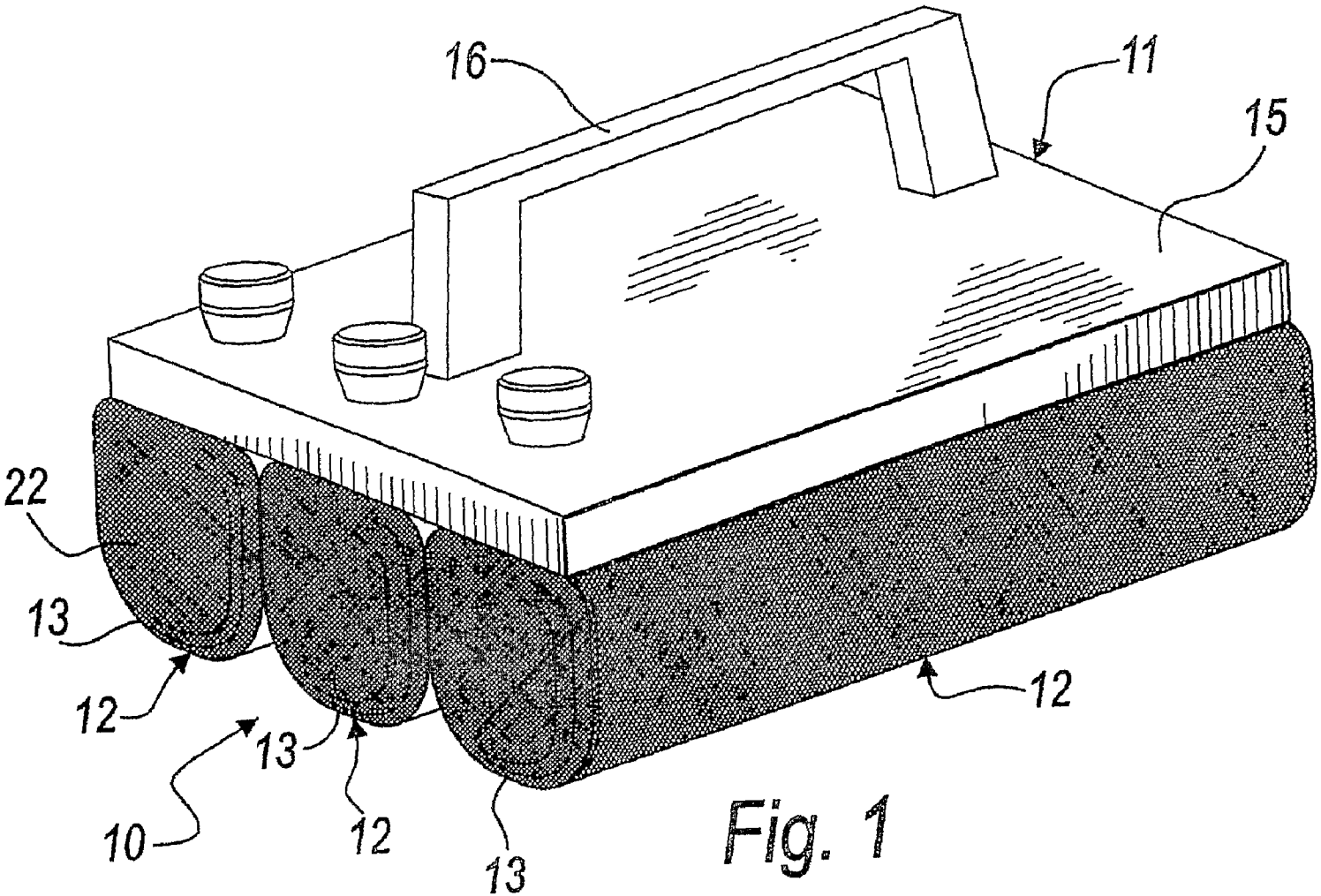
FIG. 1 is an axonometric view of a first embodiment of the apparatus according to the invention.
Figure 2:
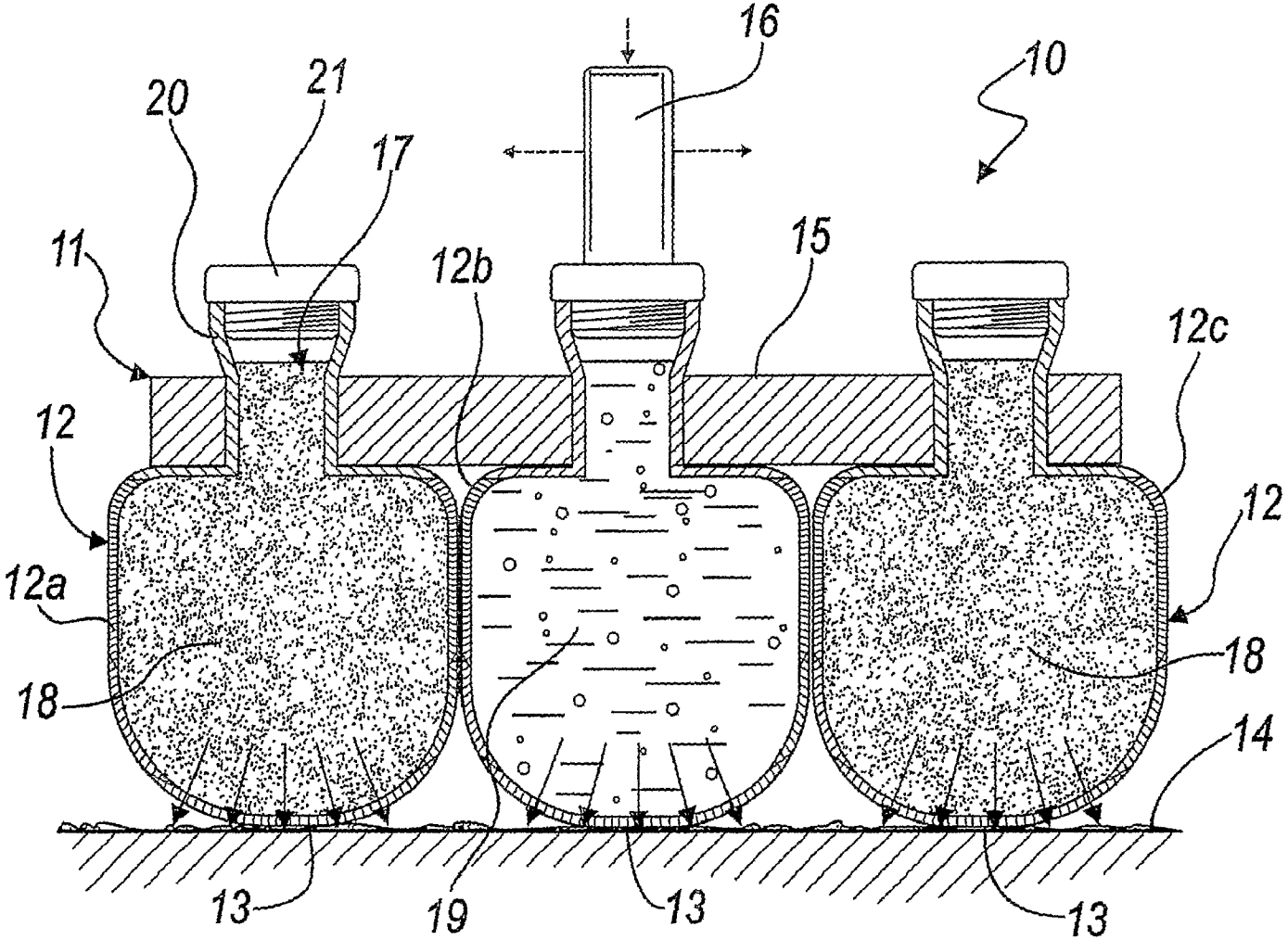
FIG. 2 is a cross section view of the apparatus of FIG. 1.

With reference to the aforementioned FIGS. 1 and 2, an apparatus for the deep cleaning of surfaces, according to the invention, is collectively identified by numeral 10.

Such apparatus 10 comprises a support 11 for three reservoirs 12 disposed side-by-side and provided with deformable walls, which present corresponding uniformly perforated faces 13 essentially facing the direction of the surface to be cleaned, herein identified by numeral 14. Specifically, support 11 consists of a plate 15, onto which reservoirs 12 are fixed on one side.

A gripping handle 16 for the hand of a user is arranged on such plate 15, on the side opposite to that onto which reservoirs 12 are fixed.

As mentioned, each reservoir 12 is perforated on corresponding face 13 facing surface 14 to be cleaned.

In this embodiment, the walls of each reservoir are entirely perforated (except for the part facing support 11).

The walls of such reservoirs 12 are deformable and formed, for example, by a fabric, in which spaces between warp and fill constitute through holes. It is apparent that all sorts of materials may be used for forming said reservoirs, such as, for example: perforated non-woven fabrics, perforated elastomeric material or other plastic material films, natural fabrics coated with plastic materials and then perforated, elasticized fabrics, etc.

Each reservoir 12 includes a closable filling opening 17 for the insertion of substances useful for the deep cleaning operation, which is described below. Specifically, a first reservoir 12*a* is tillable with sand 18, preferably of fine grain size, while a second reservoir 12*b* is tillable with a non-solid substance 19, which has the function of facilitating the flowing of the sand (which has a cleaning function) on surface 14, as better described below.

Such non-solid substance 19 may be, for example, a liquid detergent, an oily liquid substance, a cream product, a wax-based substance, glycerin, etc.

Therefore, substance 19, in addition to having the main function of facilitating the flowing of the sand on the surface, may also have a secondary function, e.g. of chemically cleaning (detergent), protecting (wax), etc.

In this first embodiment, third reservoir 12*c* is filled with the same sand 18 as first reservoir 12*a*.

It is apparent that, according to needs, a third reservoir 12*c* may be filled with sand of different type or also with substance of the same type as that of second reservoir 12*b* or also of different types.

Filling opening 17 consists, for example, of a pipe 20 thoroughly arranged through plate 15 and closed by a cap 21.

Such filling opening 17, in other embodiments, may be located in other parts of the reservoirs 12, such as, for example, the head portions 22.

The operation of the apparatus is as follows.

Reservoirs 12 are filled with sand 18 and non-solid substance 19, e.g. liquid soap.

In virtue of the density and surface tension of liquid soap 19, this tends not to be issued from the holes defined on the walls of reservoirs 12.

Similarly, also sand 18, in virtue of the aggregating effect of the close particles as well as the possible adhesive power due to the humidity in the sand, tends not to be issued from the holes of reservoirs 12.

It is possible that the sand or the soap are issued, but this occurs limitedly and certainly very slowly.

By arranging reservoirs 12 with corresponding faces 13 in contact with surface to be cleaned 14 and by exerting with the hand a pressure on support 11 in direction of surface 14, the sand and the liquid soap are issued from the holes of reservoirs 12, mixing together on surface 14.

The liquid soap-sand compound is thus moved on surface 14 by the movement tangential to the surface imposed onto faces 13 by means of the handle and the plate, by the user's hand; in practice, faces 13 drag the compound on surface 14.

The sand performs an abrasion only on that which protrudes with respect to the main level of surface 14 (such as, for example, rust on a metallic surface) or of those particles of dirt which are nested in small recesses, niches, indentations defined on surface 14 (such as, for example, in the case of wall surfaces).

The soap or other non-solid substance allows the sand to flow on the main level of the surface without being excessively 'aggressive' with respect to this surface.

It is apparent that the sand may be of different types: it must be sufficiently hard for the type of application and must not dissolve in the dense non-solid substance.

It is apparent that two is the minimum number of reservoirs, one for the sand and one for the non-solid substance, and that a number of reservoirs according to needs may be added to these in other embodiments (such as in the present case).

It has been experimentally verified that the use of a sand and non-solid substance compound previously mixed inside a reservoir does not allow an issuance of the product from the holes of the reservoir.

Figure 3:
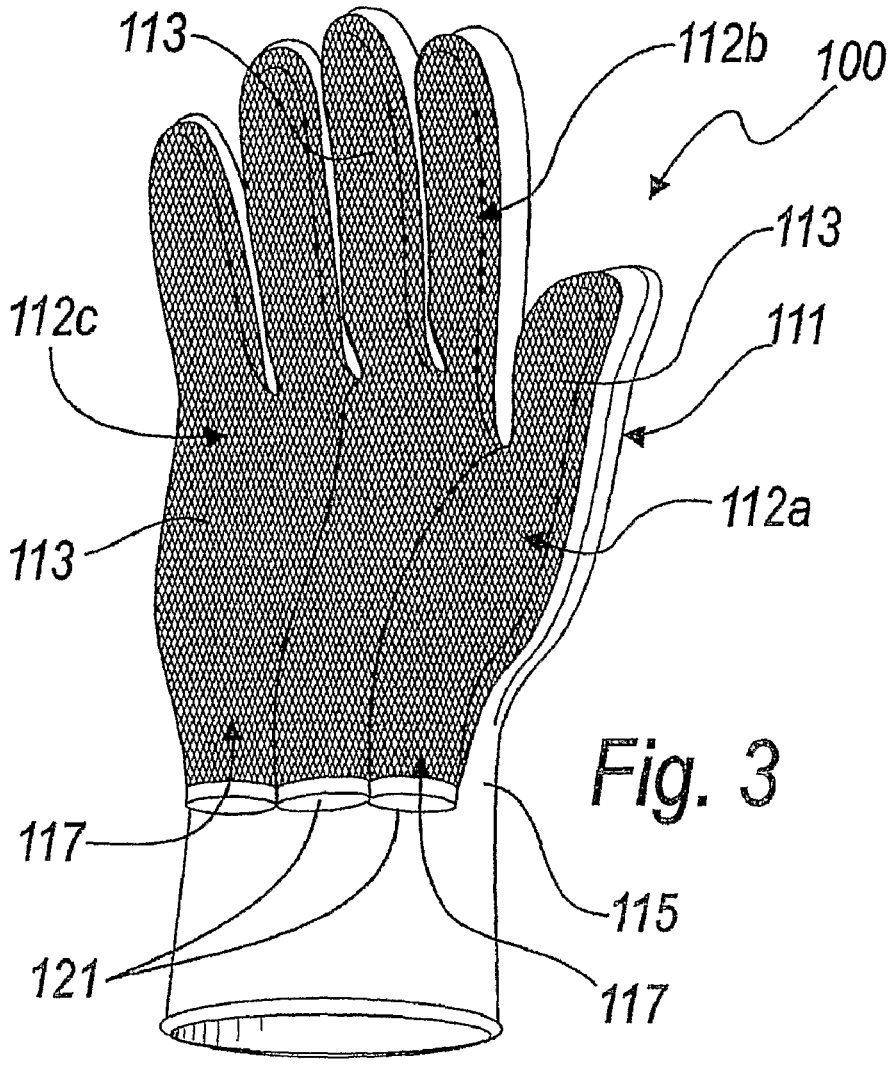
FIG. 3 is an axonometric view of a second embodiment of the apparatus according to the invention.
Figure 4:
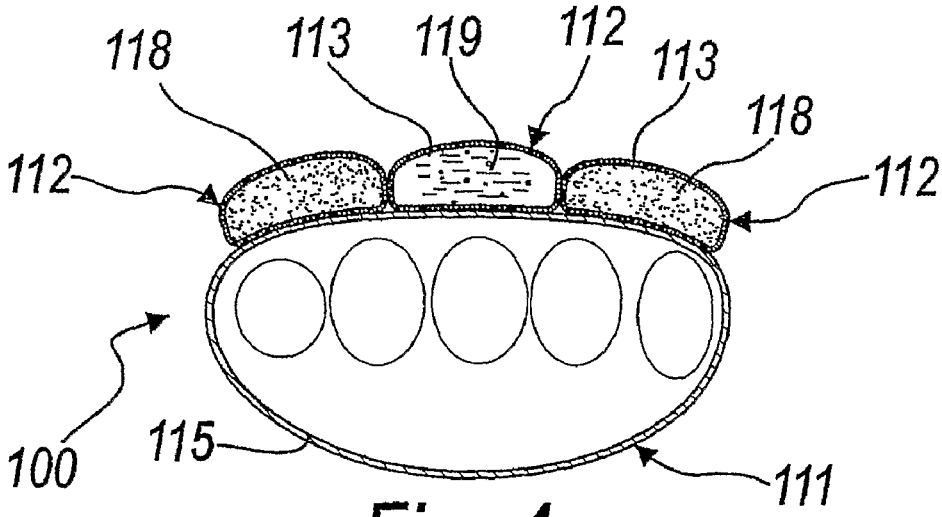
FIG. 4 is a cross section view of the apparatus of FIG. 3.

A second embodiment of apparatus according to the invention is shown in FIGS. 3 and 4 and is collectively identified by numeral 100.

In this embodiment, the support, now identified by numeral 111, consists of a glove 115 wearable by a user. On such glove 115, on the side of the palm of the hand, there are fixed three reservoirs 112, the walls of which are deformable and are formed by materials similar to those of the previous example.

Faces 113 of such reservoirs 112, throughly perforated, are those related to the side opposite to the palm of the hand.

Such reservoirs are developed, for example, along the main directions of the glove 115 related to the fingers; the first reservoir 112*a*, for example, relates to a first portion of the palm of the hand and to the thumb, the second reservoir 112*b* relates to a second portion of the palm next to the first portion and to the index and middle fingers and finally the third reservoir 112*c* relates to the last portion of the palm and to the ring and little fingers.

Reservoirs 112 are filled with sand 118 and non-solid substance 119 of the same type as in the previous example.

Three filling openings 117, closed by caps 121, are present at the zone of glove 115 corresponding to the wrist.

The operation is similar to the previous example; with the pressure of the hand inside the glove against the surface to be cleaned, the sand and the non-solid substance are issued from the corresponding reservoirs and mixed; the tangential movement of the hand brings the compound thus formed to the surface, so that the sand eliminates the asperities and the dirt.

In variant embodiments with respect to the embodiment just set forth (not shown in the figures), reservoirs 12-112 may be provided with reversible fastening means to support 11-111 (plate or glove), so as to be able to replace them with new reservoirs once they are worn out due to the inevitable wear to which they are subjected during the sliding on the surfaces to be cleaned.

It has been in practice observed that the invention thus described solves the highlighted problems of the known art; specifically, the present invention provides an apparatus for the deep cleaning of surfaces which allows obtaining extremely smooth and clean surfaces without damaging the original surface layer.

This is obtained by using sand as a cleaning means with the non-solid substance; the sand indeed eliminates all of the surface impurities while the non-solid substance allows a flowing of the sand onto the surface without damaging the original layer and possibly exerting other effects, such as for example a deterging effect.

The use of perforated reservoirs side-by-side containing such products provides for an easy, continuous distribution of the products on the surface to be cleaned.

The invention thus devised is susceptible to a number of changes and variants all within the scope of the inventive concept; furthermore, all details may be replaced by other technically equivalent elements.

In practice, any materials, if compatible with the specific use and dimensions, may be used according to the needs and the state of the art. Where the features and techniques mentioned in any claim are followed by references signs, such reference signs are included for the sole purpose of increasing intelligibility of the claims and consequently such reference signs have no limiting effect on the interpretation of each element identified by way of example by such reference signs.

The invention claimed is:

1. An apparatus for the deep cleaning of surfaces comprising:

a support for at least two reservoirs, each of the reservoirs being arranged side-by-side and being provided with deformable walls having uniformly perforated faces substantially facing the direction of a surface to be cleaned, said at least two reservoirs being removably fastened to said support, at least one of said reservoirs being configured to contain a solid cleaning granular material for cleaning said surface, and at least one of said reservoirs being configured to contain a fluid substance facilitating a flowing of the granular material onto said surface to be cleaned, wherein the deep cleaning is obtained by a pressure exerted by a user onto said support in a direction of the surface to be cleaned, and said granular material and said fluid substance flowing from the reservoirs and being mixed together onto said surface to be cleaned during a tangential movement of said apparatus onto the surface to be cleaned, said uniformly perforated faces of said reservoirs conveying onto the surface a compound of the granular material and the fluid substance having a cleaning effect.

2. The apparatus according to claim 1, wherein the deformable walls of each reservoir are completely perforated except for portions of the deformable walls facing the support.

3. The apparatus according to claim 1, wherein each reservoir has a closable opening for the filling of the reservoir.

4. The apparatus according to claim 3, wherein said support comprises a plate, onto which said reservoirs are affixed on one side.

5. The apparatus according to claim 4, wherein said closable openings comprise pipes each arranged through said plate and having a closing cap.

6. The apparatus according to claim 4, wherein said closable openings are located in head portions of said reservoirs.

7. The apparatus according to claim 4, wherein said plate has a gripping handle for the user, the gripping handle being disposed on a side of the plate opposite to the side, upon which the reservoirs are affixed.

8. The apparatus according to claim 1, wherein materials forming said reservoirs are selected from the group consisting of a fabric having spaces between warp and fill that provide flowing holes for the granular material and said fluid substance, a perforated non-woven fabric, a perforated elastomeric material film, a perforated plastic material film, a natural fabric coated with a plastic material and subsequently perforated, and an elastic fabric.

9. The apparatus according to claim 8, wherein different ones of the reservoirs have flowing holes of different dimensions.

10. The apparatus according to claim 1, wherein said fluid substance is selected from the group consisting of a liquid detergent, an oily liquid substance, a cream product, and a wax-based substance.

11. The apparatus according to claim 1, wherein the support comprises a glove wearable by a user, said reservoirs being affixed onto at least a portion of a palm of the glove.

12. The apparatus according to claim 11, wherein the perforated faces of said reservoirs are disposed on a facing portion of the glove opposite to the palm.

13. The apparatus according to claim 11, wherein each reservoir has a closable opening for the filling thereof disposed in a wrist portion of the glove.

14. The apparatus according to claim 11 wherein said reservoirs are disposed in a palm and fingers portion of the glove.

15. The apparatus according to claim 1, wherein the granular material is sand.

16. The apparatus according to claim 1, wherein the at least one of said reservoirs containing of a fluid substance is perforated with holes dimensioned to allow flow of the fluid substance only when a pressure applied to the at least one of said reservoirs exceeds a predetermined level.

17. The apparatus according to claim 1, wherein the at least two reservoirs are configured to contain a blend of the granular substance with the fluid substance.

18. The apparatus according to claim 1, wherein the fluid substance is chemically configured to have detergent properties.

* * * * *